US008235655B1

(12) United States Patent
Pankey et al.

(10) Patent No.: US 8,235,655 B1
(45) Date of Patent: Aug. 7, 2012

(54) VARIABLE INLET GUIDE VANE ASSEMBLY

(75) Inventors: William W. Pankey, Palm Beach Gardens, FL (US); Jack W. Wilson, Jr., Palm Beach Gardens, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 34 days.

(21) Appl. No.: 13/072,687

(22) Filed: Mar. 26, 2011

Related U.S. Application Data

(63) Continuation of application No. 12/558,901, filed on Sep. 14, 2009, now Pat. No. 7,922,445.

(60) Provisional application No. 61/098,322, filed on Sep. 19, 2008.

(51) Int. Cl.
*F01B 25/02* (2006.01)

(52) U.S. Cl. ..... 415/160

(58) Field of Classification Search ..... 415/160, 415/161, 148, 151, 159
See application file for complete search history.

(56) References Cited

U.S. PATENT DOCUMENTS 3,318,513 A * 5/1967 Johnson ..... 415/161

* cited by examiner

*Primary Examiner* — Edward Look
*Assistant Examiner* — Aaron R Eastman
(74) *Attorney, Agent, or Firm* — John Ryzinc

(57) ABSTRACT

A variable inlet guide vane assembly for a gas turbine engine, where the guide vanes are pivotably connected to a sync ring that is contained within an annular groove within the casing so that leakage through holes in the casing is minimized. The guide vanes include a slider mechanism on one of the ends that will allow for both an axial and a rotational movement of the guide vane pin when the guide vanes pivot about a fixed pin on an opposite end of the guide vanes. A round rotary vane actuator with a height much less than a diameter is mounted outside of the casing and connects to the sync ring through a driving linkage.

6 Claims, 9 Drawing Sheets

VARIABLE INLET GUIDE VANE ASSEMBLY

CROSS-REFERENCE TO RELATED APPLICATIONS

This application is a CONTINUATION of U.S. patent application Ser. No. 12/558,901 filed on Jan. 14, 2009 and entitled VARIABLE INLET GUIDE VANE WITH ACTUATOR which was issued as U.S. Pat. No. 7,922,445 issued on Apr. 12, 2011; which claims the benefit to an earlier filed Provisional Application 61/098,322 filed Sep. 19, 2008 and entitled VARIABLE INLET GUIDE VANE WITH ACTUATOR.

FEDERAL RESEARCH STATEMENT

None.

BACKGROUND OF THE INVENTION

1. Field of the Invention

The present invention relates generally to a gas turbine engine, and more specifically to a variable inlet guide vane and an actuator for the variable inlet guide vane.

2. Description of the Related Art Including Information Disclosed Under 37 CFR 1.97 and 1.98

A gas turbine engine includes a compressor with multiple rows of rotor blades spaced between multiple rows of stator vanes to gradually compress air for delivery to a combustor. Many gas turbine engines include a first stage of inlet guide vanes that are variable in order to change the angle of each guide vane.

In many engines with variable inlet guide vanes, each vane is pivotably connected to an actuator in which a radial extending pin passes through a hole formed within the casing that is attached to an actuator or to a linkage that is attached to an actuator. Each guide vane includes a pin that extends through a separate hole formed in the casing so that each guide vane can be moved together. Because each guide vane requires a hole in the casing, leakage of the air flow passing through the guide vanes is high.

In the variable inlet guide vanes of the prior art in which each guide vane includes a linkage to connect it to the driving motor, the linkage is complex with several linkages that create a complex assembly, and that will involve large tolerances especially when wear occurs between the links.

Another issue with the prior art variable inlet guide vanes is that the actuator used to drive the guide vanes is a rather large piston cylinder that is both heavy and takes up a lot of space. In an aero engine of the type used to power an aircraft, both weight and size are important matters related to the engine efficiency. Space is limited for the engine and its components. The prior art actuators are large linear piston actuators that drive the linkage connecting the guide vanes.

BRIEF SUMMARY OF THE INVENTION

The variable inlet guide vane assembly of the present invention in which each variable guide vane is connected to a linkage that is fully contained within the casing. An inner facing circumferential groove is formed within the casing in which an annular sync ring moves in a circumferential direction. Each guide vane is connected to the sync ring within the casing. The sync ring is connected to a driving motor through a hole in the casing so that a minimal number of holes are used to reduce leakage. Circumferential movement of the sync ring pivots each guide vane to change the angle.

DETAILED DESCRIPTION OF THE INVENTION

Figure 1:
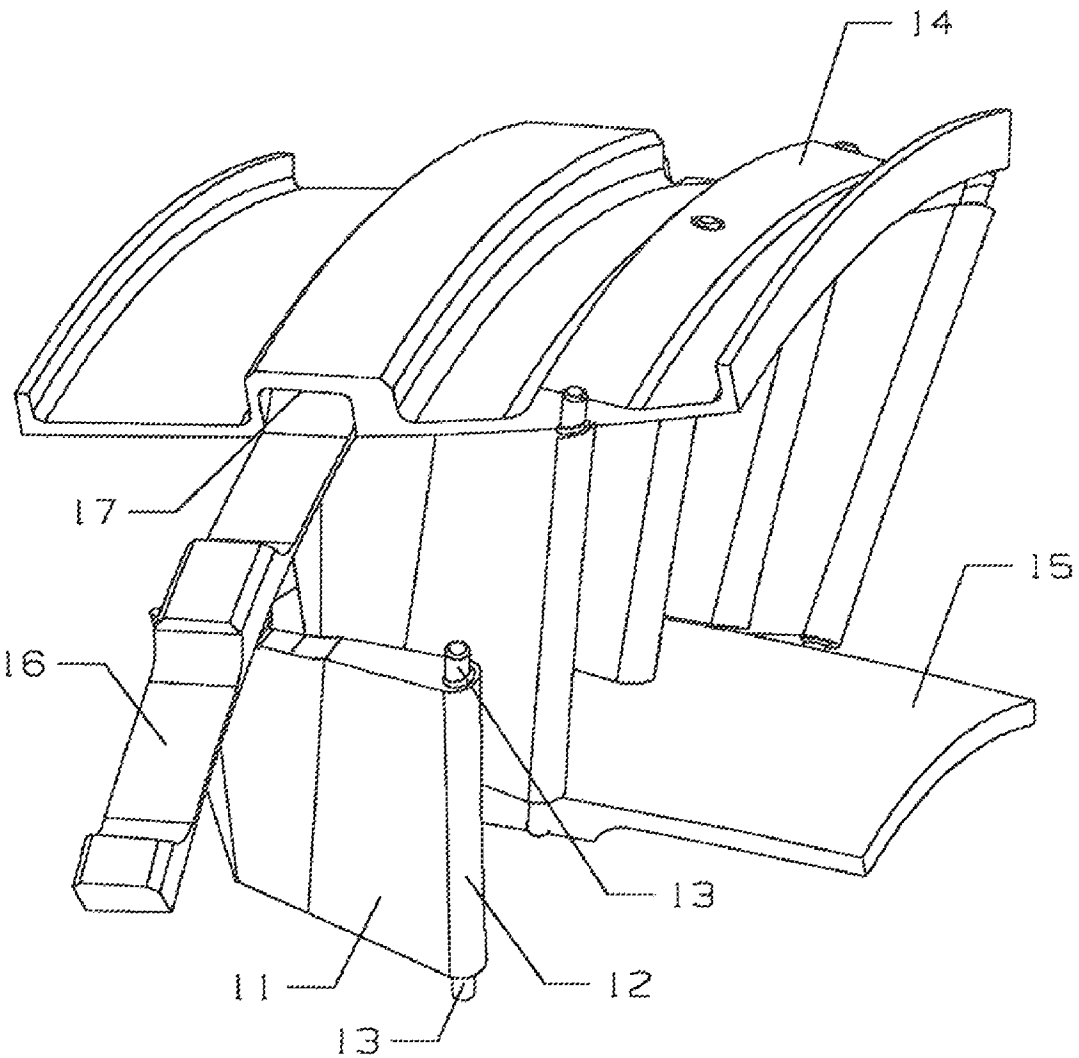
FIG. 1 shows an isometric view of the variable inlet guide vane of the present invention from the leading edge side.

FIG. 1 shows the inlet guide vane assembly with a vane 11 having a leading edge 12 with pivot pins 13 on the inner and outer ends to allow for the vane to pivot within the flow path. The pivot pins 13 fit within holes formed in the outer shroud 14 and an inner shroud 15 that also form the flow path through the inlet guide vane assembly.

Figures 2, 3:
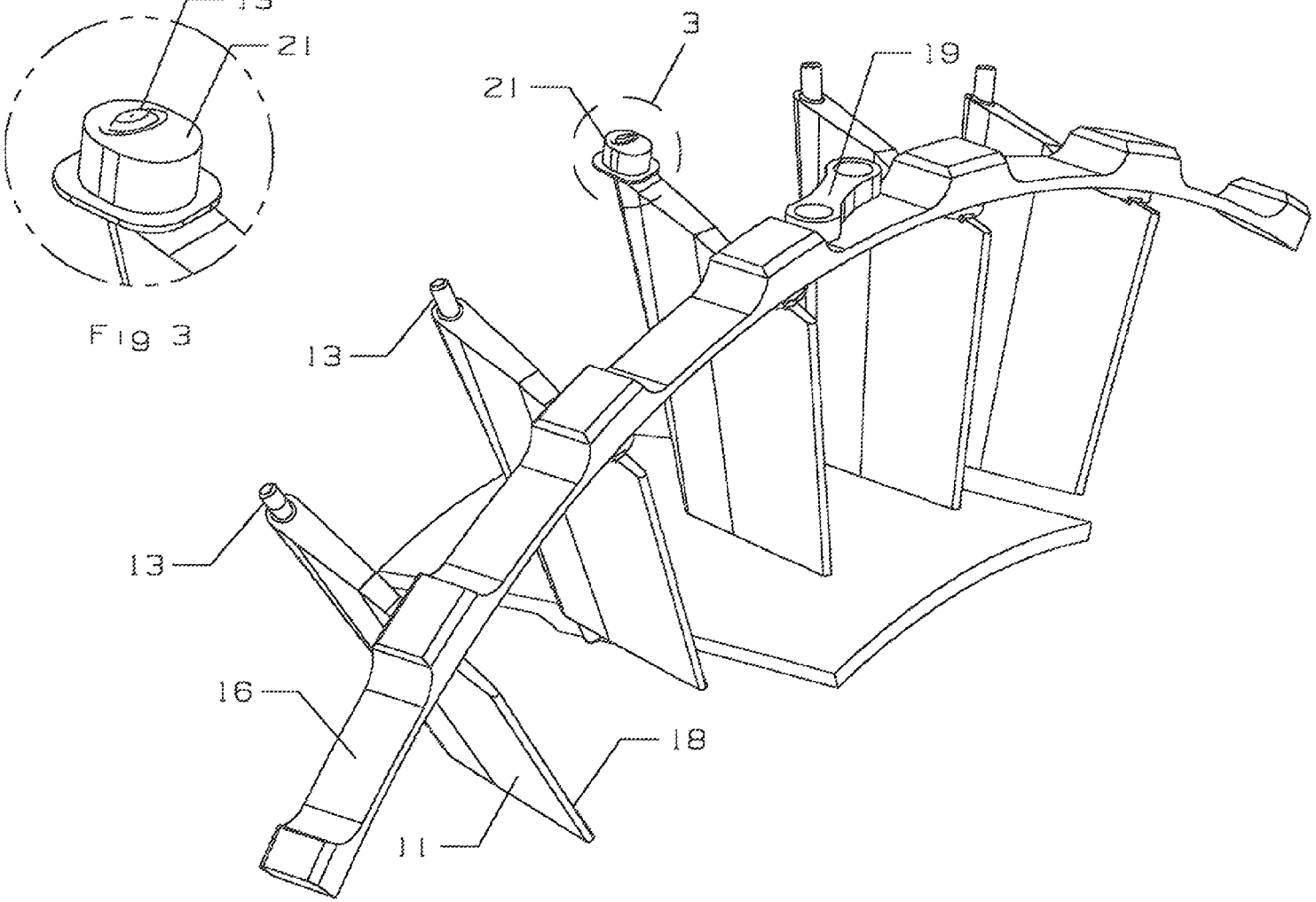
FIG. 2 shows an isometric view of the variable inlet guide vane of FIG. 1 from the trailing edge end and without the outer casing.
FIG. 3 shows an enlarged view of the Detail A in FIG. 2.

A sync ring 16 is used to move the vanes within the shroud assembly. The sync ring 16 is a full 360 degree annular piece that slides within an inner facing annular groove 17 arranged within the outer shroud 14 member as seen in FIG. 1. As the sync ring 16 is moved circumferentially within the annular groove 17, the guide vanes 11 are pivoted to the different positions. FIG. 2 shows the guide vane assembly from the trailing edge side 18 of the vanes 11 with the leading edge side pivot pins 13 shown. The sync ring 16 is connected to the vanes 11 near the trailing edge side. A driving linkage 19 connects the sync ring 16 to an actuator that is used to move the sync ring and thus position the guide vanes 11.

In one embodiment, the sync ring 16 includes a radial pin that slides within a slot formed within the casing to connect the sync ring 16 to the actuator outside of the casing. In this embodiment, the driving linkage 19 would be connected to the actuator outside of the casing. In another embodiment, the driving linkage would be contained within the casing and another connection would be used to connect the actuator to the driving linkage through a hole or slot within the casing.

The leading edge side pins 13 are pivotable within a slider 21 that is formed as a loader slot bearing to allow for both circumferential movement and axial movement of the pins 13 when the guide vanes are moved. The slider linkage 21 includes a spherical piece that slides within a spherical hole formed within the outer shroud, and a cylindrical hole formed within the spherical piece in which the pin 13 rotates. Because the trailing edge side pins connected to the sync ring 16 only follows a circumferential motion, the leading edge side pins 13 must be allowed to move in both the circumferential direction and the axial direction (the axis of the engine) when the vanes are pivoted. FIG. 3 shows a detailed view of the slider with the pin 13 extending through the central hole formed within the spherical piece.

Figure 4:
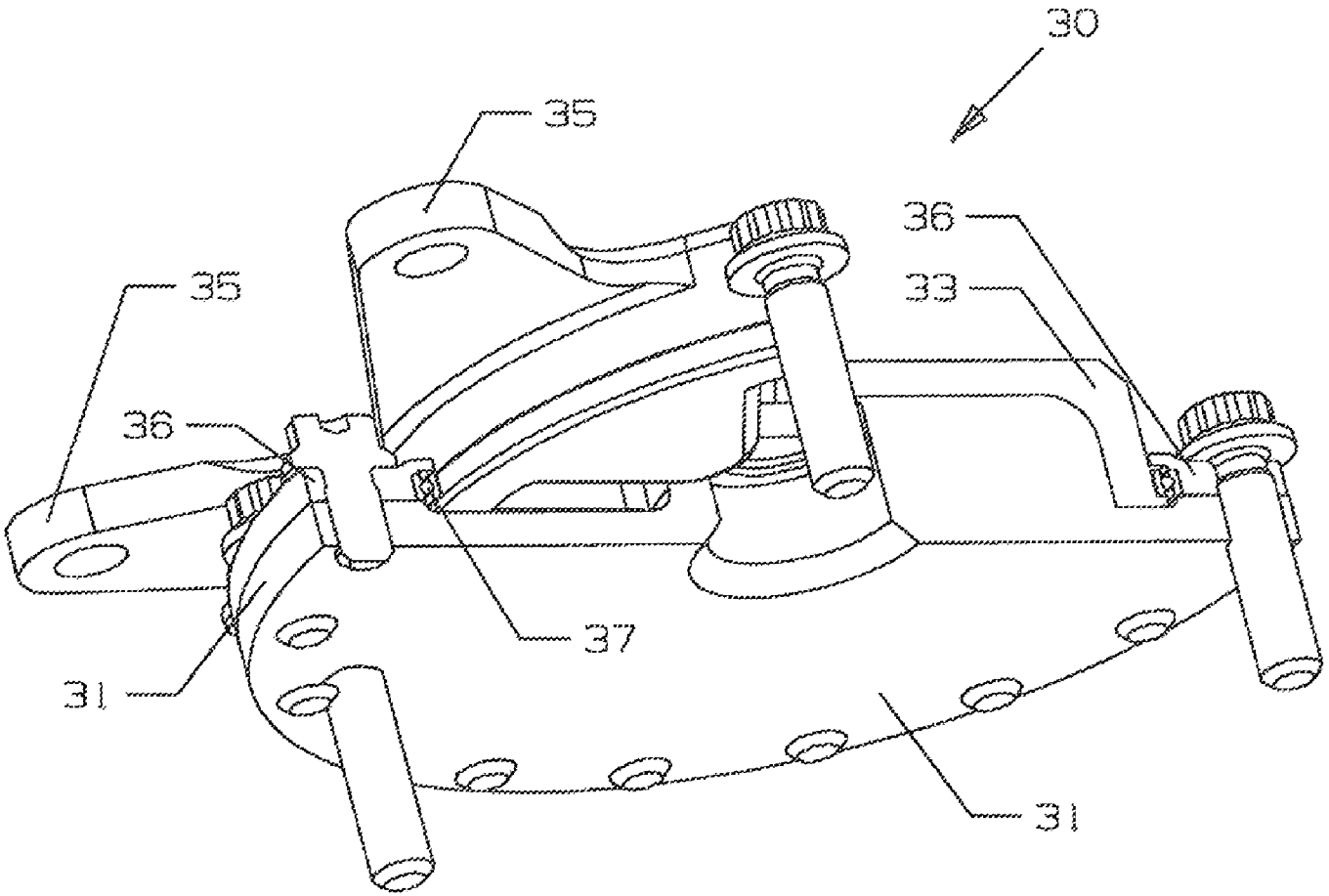
FIG. 4 shows an isometric view of the actuator of the present invention.
Figure 5:
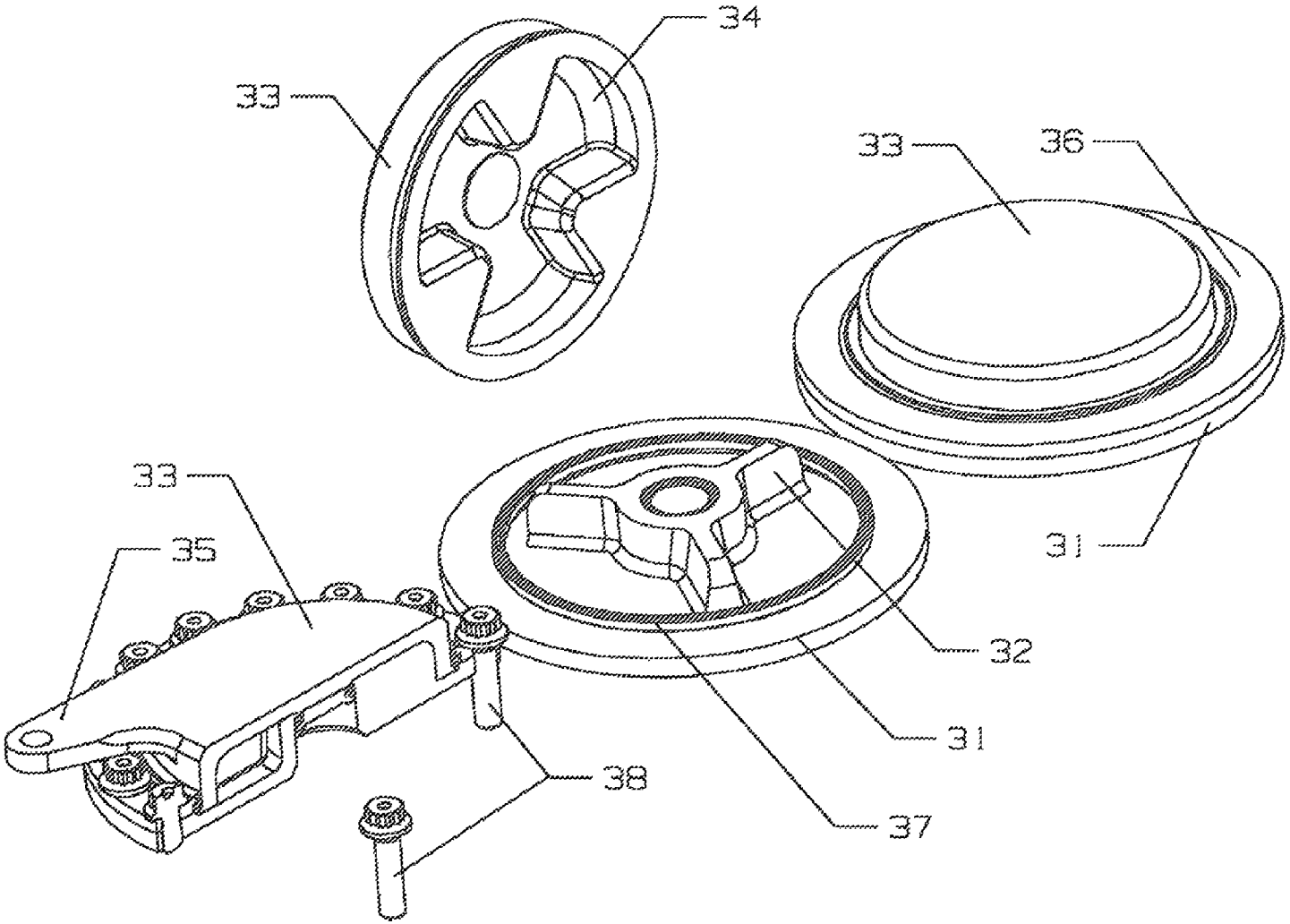
FIG. 5 shows an exploded view of the parts in the actuator of FIG. 4.

FIG. 4 shows a "pancake" (round actuator with a height much less than the diameter) actuator 30 used to move the sync ring 16 for positioning the guide vanes 11. The pancake actuator 30 is a three vane actuator with a relatively short height to minimize the space required for the actuators around the engine casing and to minimize the weight of the actuators. The prior art guide vane actuators are larger linear actuators that require at least twice the overall length for the same movement of the output mechanism that is used to move the sync ring 16. FIG. 5 shows an exploded view of the parts that make up the pancake actuator 30 and includes a stator with three vanes 32 offset at 120 degrees, a rotor 33 that forms the pressure chambers 34 for each of the vanes 32, an actuator arm 35 extending from the rotor 33 that connects to the driving linkage 19 of the sync ring 16, and an outer bearing ring 36 that is bolted onto an outer surface of the stator and rotatably secures the rotor 33 to the stator 31. FIG. 4 shows the arrangement with the outer bearing ring 33 securing the rotor 33 to the stator 31 with roller bearings 37 formed around the inner side of the outer bearing ring 33 and the outer side of the rotor 33 to allow for relative rotation. FIG. 4 shows the actuator arm 35 in the two extreme positions. A number of bolts 38 secure the outer bearing ring 36 to the stator 31.

Figure 6:
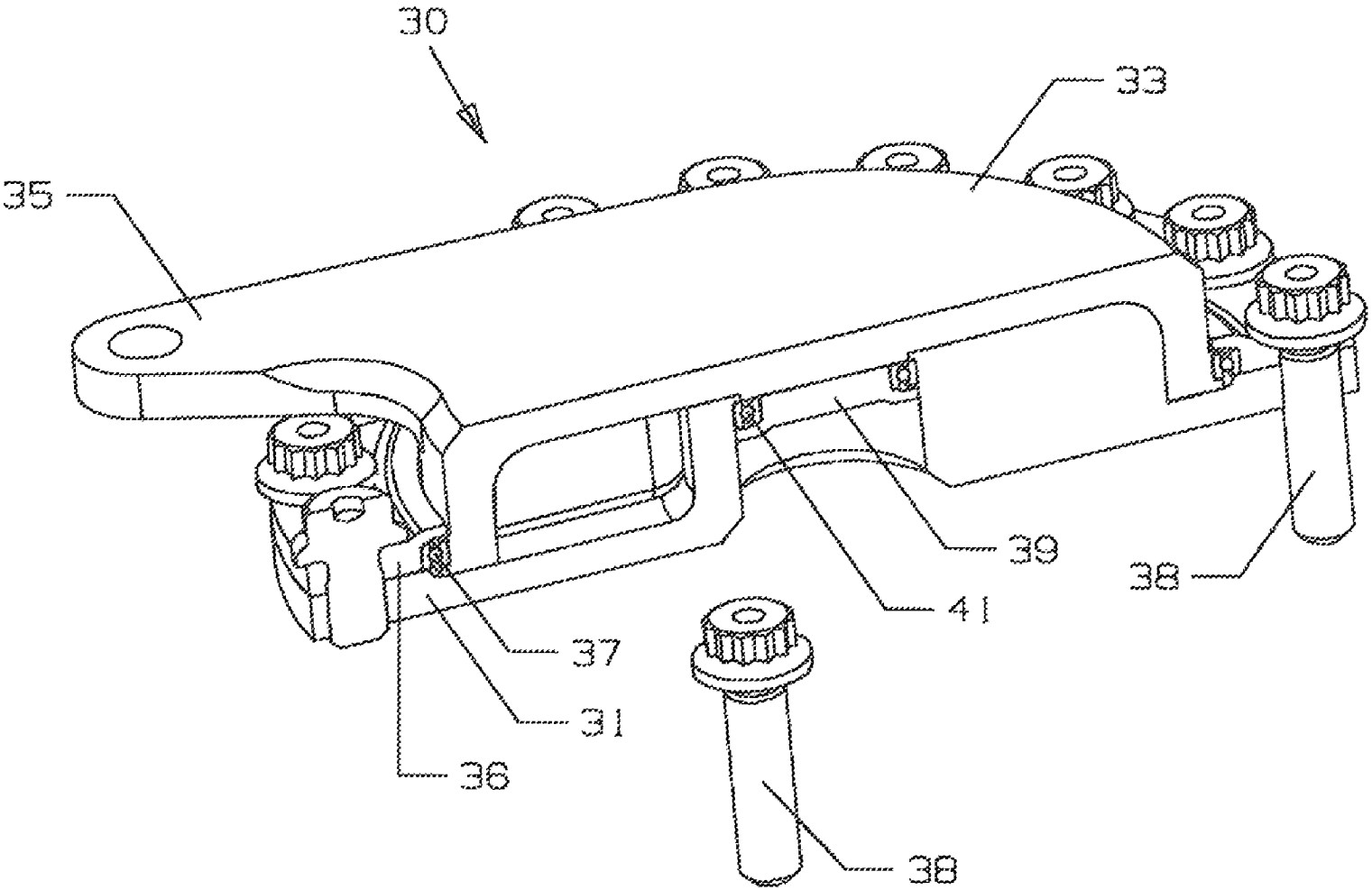
FIG. 6 shows an isometric view of the back half of the actuator of the present invention.
Figure 7:
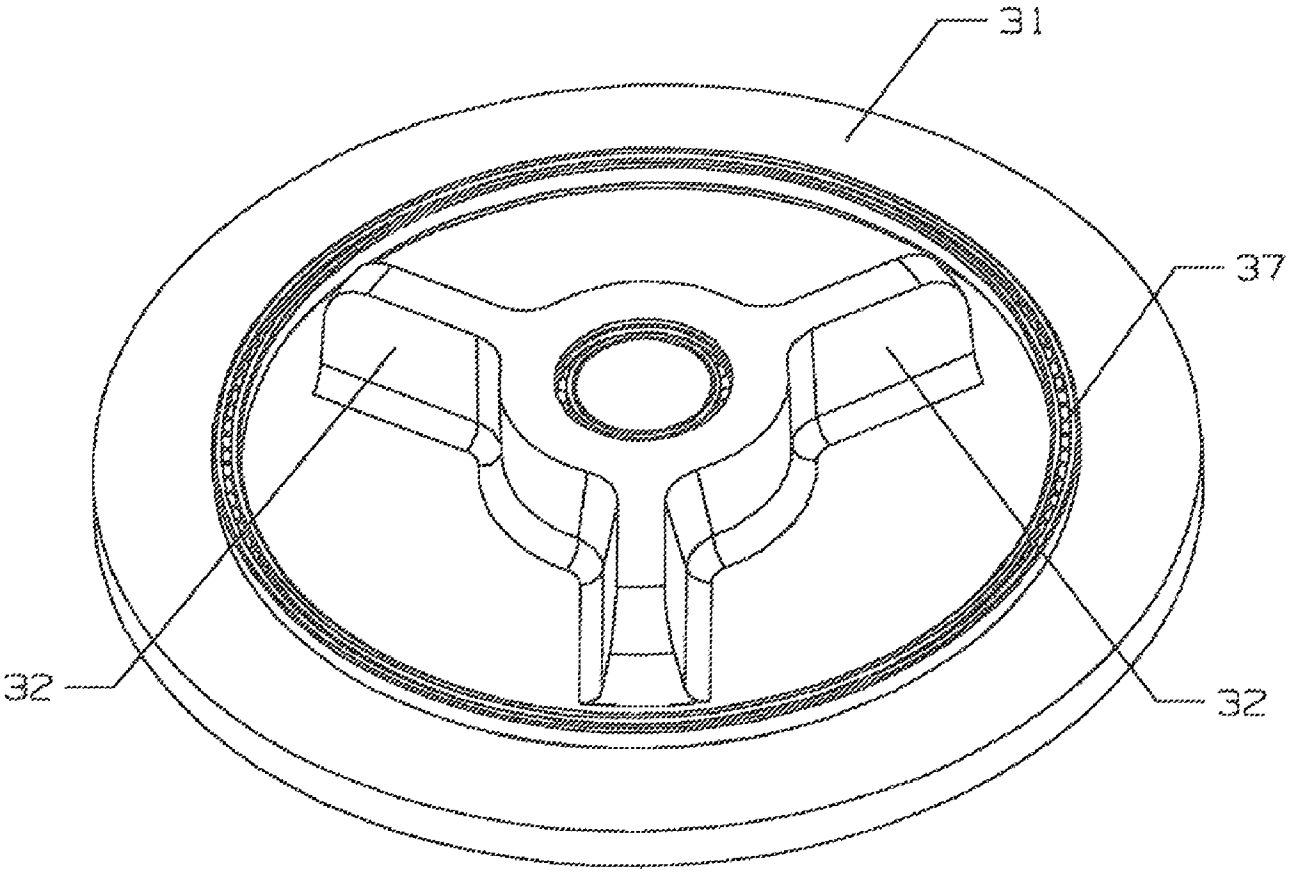
FIG. 7 shows an isometric view of the three vane piston used in the actuator of the present invention.

FIG. 6 shows a cut-away view of the actuator 30 with an inner bearing ring 39 rotatably secured to an inner surface of the stator 31, the inner bearing ring 39 being secured to the rotor 33. FIG. 7 shows the rotor 31 with the outer bearing 37 and the three vanes 32 extending up from the base of the disc of the rotor 31. The inner bearings 41 are shown in the central opening of the rotor 31. One of the benefits of the pancake actuator is that the power output of the actuator can be increased by using vanes 32 with taller heights so that the same input driving pressure can produce a larger output force to drive the sync ring 16.

Figure 8:
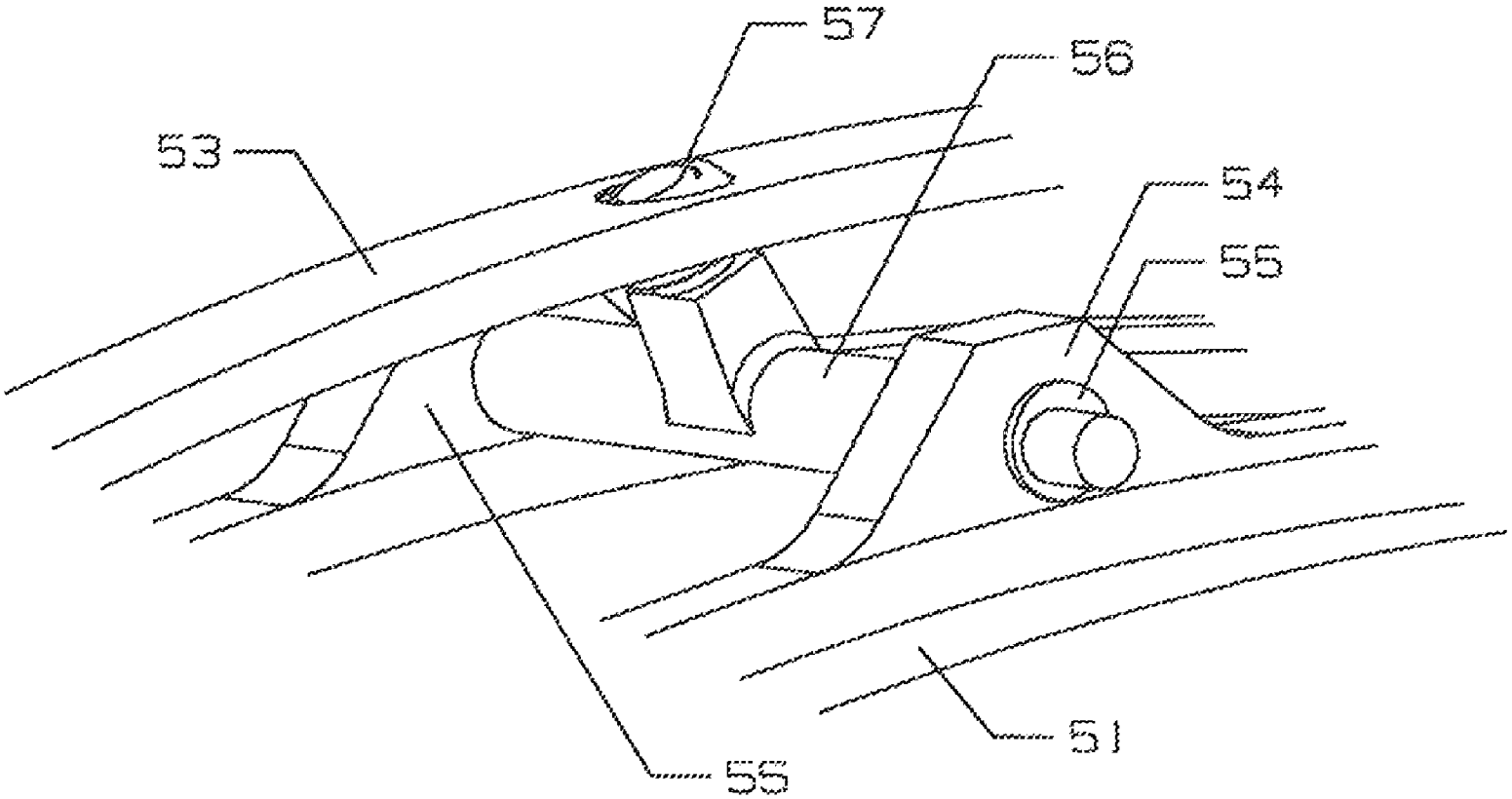
FIG. 8 shows an isometric view of a linkage for a vane tip clearance control device of the present invention.
Figure 9:
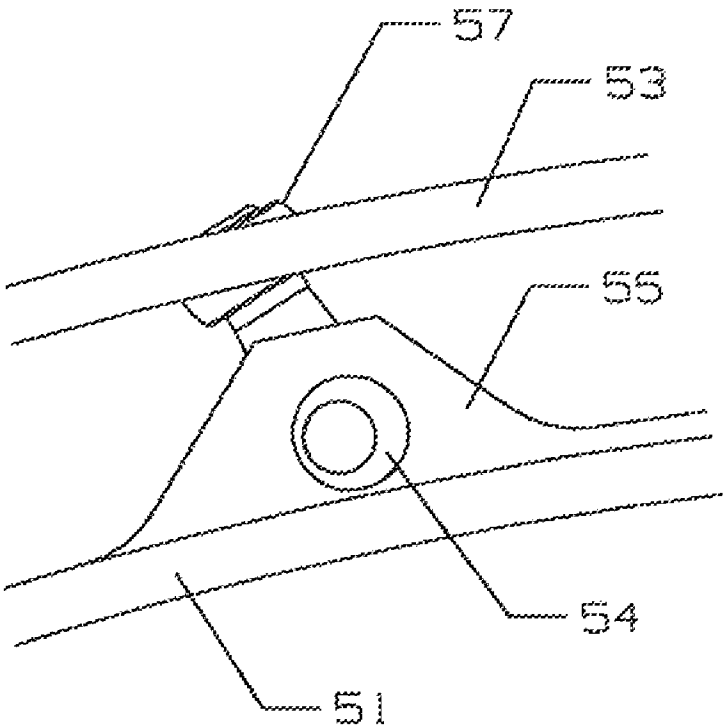
FIG. 9 shows a side view of the linkage of FIG. 8.
Figure 10:
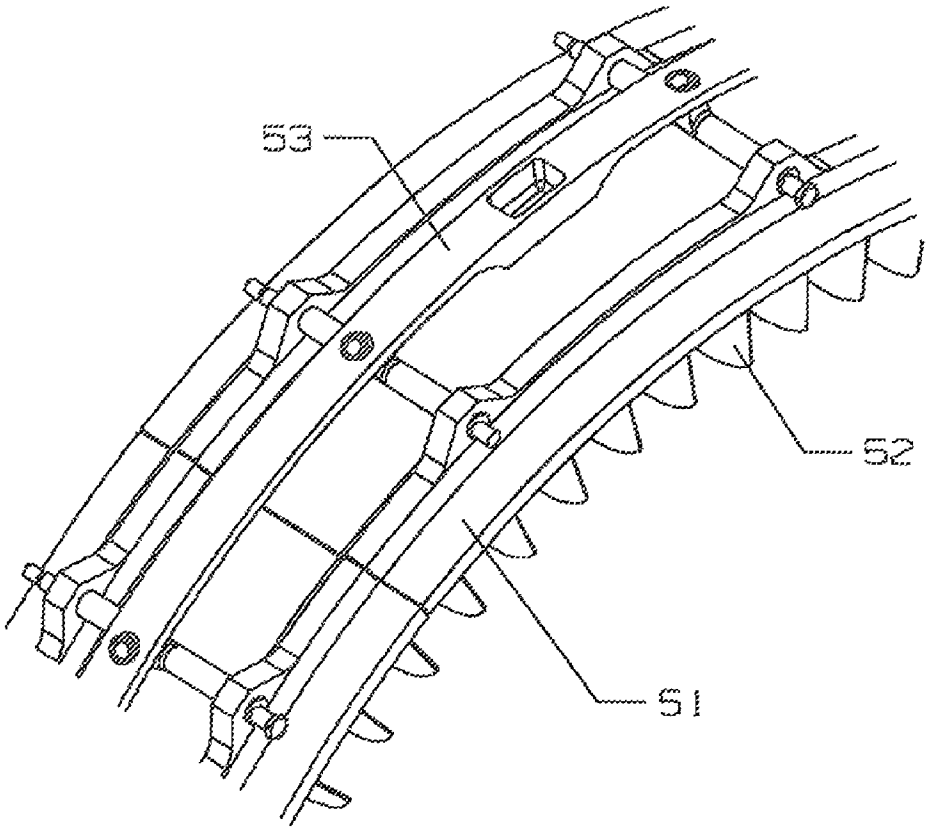
FIG. 10 shows an isometric view of the vane tip clearance control apparatus of the present invention.

FIGS. 8-10 show a segmented guide vane assembly with tip clearance control. FIG. 10 shows a plurality of shroud segments 51 each having a plurality of vanes 52 extending inward into a flow path. An annular sync ring 53 is positioned outside of the shroud segments 51 and is connected to the segments 51 by a linkage that produces a radial movement of the segments 51 to control the vane tip clearance with the inner shrouds of the engine. FIG. 8 shows an isometric view of one of the linkages between the shroud segment 51 and the sync ring 53. Each shroud segment 51 includes two raised portions 54 near the ends and on both the forward side and the aft side where each raised portion 54 includes a hole in which an eccentric cam pivots. The eccentric cam 55 includes a hole to allow for a pivot arm 56 to slide. The pivot arm 56 includes a radial extending piece that fits within a slider (loader slot bearing) 57 fitted within a spherical hole in the sync ring 53. The slider 57 allows for the circumferential movement of the sync ring 53 to produce a pivoting of the shaft of the pivot arm 56 and thus a rotation of the shaft that rotates within the eccentric cam 55 fitted within the raised portions 54 of the shroud segments 51. FIG. 9 shows a side view of the pivot arm linkage between the raised portion 55 of the shroud segment 51 and the sync ring 53.

The sync ring 53 can be connected to the pancake actuator described above for actuating the sync ring 53. When the sync ring 53 is moved in the circumferential direction, the pivot arms 56 are rotated so that the shroud segments 51 are moved in the radial direction of the engine to control the guide vane tip clearance. If the two position pancake actuator 30 is used, then the vane tip clearance control has two positions: a first position with the vane tips moved the further inward and a second position with the vane tips moved furthest outward.

The pancake actuator of the present invention can be supplied with a differential pressure that is bled off from the compressor using one of the stages that has a pressure level high enough to drive the actuator and move the sync ring. Since the actuator is of the type with a high pressure side and a low pressure side, connecting the low pressure chamber to the ambient while connecting the high pressure side to the compressor stage will provide enough differential pressure to drive the actuator. Since a differential pressure is being used as the motive power source, very little fluid flow is used so that the compressed air from the compressor is not wasted. Also, more than one pancake actuator can be placed around the outer shroud and connected to the sync ring in order to produce enough driving force to rotate the sync ring. In one embodiment, four pancake actuators can be evenly spaced at around 90 degrees from each other around the outer shroud casing and all connected to the sync ring by a separate actuator arm. If more power is needed or the use of less that four pancake actuators is required, the actuator vanes can be easily replaced with larger or taller vanes and the rotor can be replaced with one that accommodates the taller vanes in order to produce more power from the same differential pressure source.

We claim the following:

1. A variable inlet guide vane assembly for an axial flow compressor comprising:

an outer shroud and an inner shroud forming a flow path through the guide vanes;

an inner facing annular groove opening on the outer shroud; a row of guide vanes each having a leading edge region and a trailing edge region;

a single annular sync ring secured within the inner facing annular groove to allow for circumferential movement of the sync ring;

the row of guide vanes each connected to the sync ring such that a circumferential movement of the sync ring will produce a pivoting movement of the row of guide vanes; and, the single annular sync ring occupies all of the space of the inner facing annular groove such that only circumferential movement is allowed.

2. The variable inlet guide vane assembly of claim 1, and further comprising:

the trailing edge region of each guide vane is connected to the sync ring.

3. The variable inlet guide vane assembly of claim 1, and further comprising:

each guide vane includes a forward pin extending from a leading edge region of the guide vane and an aft pin extending from a trailing edge region of the guide vane;

the forward pin of each guide vane is connected to the outer shroud so that movement of the forward pins occur in both a circumferential direction and an axial direction; and, the aft pin of each guide vane is pivotally connected to the sync ring.

4. The variable inlet guide vane assembly of claim 3, and further comprising:

the forward pin pivots within a slider linkage.

5. The variable inlet guide vane assembly of claim 3, and further comprising:

the sync ring includes a radial pin that extends through a hole in the outer shroud; and, a driving linkage is connected between the radial pin and an actuator.

6. An axial flow compressor comprising:

an outer shroud and an inner shroud forming a flow path through the compressor;

an inner facing annular groove opening on the outer shroud;

a row of compressor blades;

a row of guide vanes located upstream of the row of compressor blades, with each guide vane having a leading edge region and a trailing edge region;

a single annular sync ring secured within the inner facing annular groove to allow for circumferential movement of the sync ring;

the row of guide vanes each connected to the sync ring such that a circumferential movement of the sync ring will produce a pivoting movement of the row of guide vanes and;

the single annular sync ring occupies all of the space of the inner facing annular groove such that only circumferential movement is allowed.

* * * * *